US012628903B2

(12) United States Patent
Fosburg et al.

(10) Patent No.: US 12,628,903 B2
(45) Date of Patent: May 19, 2026

(54) FOOTWEAR UPPER WITH COMPONENTS FOR EASIER FOOT INSERTION

(71) Applicant: Skechers U.S.A., Inc. II, Manhattan Beach, CA (US)

(72) Inventors: Jennifer Fosburg, Redondo Beach, CA (US); Bin Wang, Palos Verdes Estates, CA (US)

(73) Assignee: Skechers U.S.A., Inc. II, Manhattan Beach, CA (US)

( * ) Notice: Subject to any disclaimer, the term of this patent is extended or adjusted under 35 U.S.C. 154(b) by 0 days.

(21) Appl. No.: 18/793,734

(22) Filed: Aug. 2, 2024

(65) Prior Publication Data

US 2026/0033586 A1 Feb. 5, 2026

(51) Int. Cl.

| | |
|---|---|
| ***A43B 23/08*** | (2006.01) |
| ***A43B 7/1405*** | (2022.01) |
| ***A43B 7/144*** | (2022.01) |
| ***A43B 11/00*** | (2006.01) |
| ***A43B 13/14*** | (2006.01) |
| ***A43B 21/24*** | (2006.01) |

(52) U.S. Cl.
CPC ..... *A43B 7/144* (2013.01); *A43B 7/141* (2013.01); *A43B 13/141* (2013.01)

(58) Field of Classification Search
None
See application file for complete search history.

(56) References Cited

U.S. PATENT DOCUMENTS 1,034,075 A * 7/1912 Carey et al. ..... A43B 23/28 36/58.5
1,174,619 A * 3/1916 Scholl ..... A43B 23/28 36/68
1,895,389 A * 1/1933 Theu ..... A43B 23/28 36/55

(Continued)

FOREIGN PATENT DOCUMENTS

ES 1002249 6/1988
ES 1214014 6/2018

(Continued)

OTHER PUBLICATIONS

U.S. Appl. No. 18/641,258.

(Continued)

*Primary Examiner* — Jila M Mohandesi
(74) *Attorney, Agent, or Firm* — Marshall A. Lerner; Steven J. Kim; Daniel J. Malkin

(57) ABSTRACT

A shoe has a heel counter with heel cup. The heel cup has an upper portion with a top edge having medial elevated point and a lateral elevated point separated by a recessed point along a median line of the heel cup. The heel cup has a tapering thickness in a medial crest region and lateral crest region different from a thickness the trough region, providing differential flexibility. The shoe may have a tensioning system, wherein the tensioning system has a first tensioning system and a second tensioning system, and the first tensioning system is adjustable, and the second tensioning system is fixed. The second tensioning system may be located further from a shoe opening than the first tensioning system, and the first tensioning system is adjusted to a tension sufficient to allow a foot entry into the shoe without use of hands.

15 Claims, 14 Drawing Sheets

(56) References Cited

U.S. PATENT DOCUMENTS

| | | | | |
|---|---|---|---|---|
| 2,155,905 | A * | 4/1939 | Protz | A43B 23/28 36/68 |
| 2,958,964 | A * | 11/1960 | Abel | A43B 23/28 36/10 |
| 3,768,182 | A | 10/1973 | Powers | |
| 3,934,346 | A | 1/1976 | Sasaki et al. | |
| 4,584,783 | A | 4/1986 | Dobbin | |
| 4,608,769 | A * | 9/1986 | Sturlaugson | A43B 11/00 36/51 |
| 4,621,648 | A | 11/1986 | Ivany | |
| 4,622,763 | A | 11/1986 | Adams | |
| 4,856,207 | A | 8/1989 | Datson | |
| 5,848,457 | A | 12/1998 | Silagy | |
| 5,894,684 | A | 4/1999 | Sand et al. | |
| 6,148,489 | A | 11/2000 | Dickie et al. | |
| 6,240,657 | B1 * | 6/2001 | Weber | A43C 5/00 24/714.8 |
| 6,880,272 | B2 * | 4/2005 | Wells | A47G 25/82 36/105 |
| 6,952,890 | B1 * | 10/2005 | Blakeslee | A43C 7/06 24/712.1 |
| 8,418,381 | B2 | 4/2013 | Reagan et al. | |
| 8,769,845 | B2 * | 7/2014 | Lin | A43B 11/02 36/138 |
| 9,173,451 | B2 * | 11/2015 | Shim | A43B 23/17 |
| 9,603,417 | B2 | 3/2017 | Arevalo | |
| 9,756,903 | B1 | 9/2017 | Koo | |
| 11,076,657 | B2 | 8/2021 | Auyang | |
| 11,317,677 | B2 | 5/2022 | Auyang | |
| 11,497,278 | B2 | 11/2022 | Aoki et al. | |
| 11,877,624 | B2 | 1/2024 | Ouchi et al. | |
| 2002/0066213 | A1 | 6/2002 | Wells | |
| 2004/0194349 | A1 | 10/2004 | Delgatty | |
| 2006/0248752 | A1 | 11/2006 | Kittner et al. | |
| 2010/0319218 | A1 * | 12/2010 | Auger | A43B 7/16 36/36 B |
| 2014/0047739 | A1 | 2/2014 | Senegal | |
| 2015/0096193 | A1 * | 4/2015 | Senegal | A43C 11/22 36/51 |
| 2015/0113830 | A1 * | 4/2015 | Dillinger | A43B 23/28 12/147 R |
| 2017/0065029 | A1 | 3/2017 | Bordin | |
| 2017/0196309 | A1 * | 7/2017 | Ferguson | A43B 23/17 |
| 2018/0103727 | A1 | 4/2018 | Fracassi | |
| 2018/0110292 | A1 | 4/2018 | Beers et al. | |
| 2018/0289109 | A1 | 10/2018 | Beers et al. | |
| 2019/0045884 | A1 | 2/2019 | Uda et al. | |
| 2021/0204644 | A1 * | 7/2021 | Kyle | A43B 3/12 |
| 2022/0031024 | A1 | 2/2022 | Cook | |
| 2023/0064568 | A1 | 3/2023 | Zhang | |
| 2024/0260718 | A1 | 8/2024 | Week | |
| 2025/0120475 | A1 | 4/2025 | Greenberg | |

FOREIGN PATENT DOCUMENTS

| | | |
|---|---|---|
| GB | 1262218 | 2/1972 |
| KR | 200481311 | 7/2016 |
| NL | 2000762 | 1/2009 |
| WO | 2018081209 | 5/2018 |

OTHER PUBLICATIONS

Search Report ES202430480 dated Jul. 11, 2025.
Examination Report NZ800553 dated Jul. 14, 2025.
Search Report for ES202430475 dated Jul. 10, 2025.
Technical Examination of DK202470112 dated Jul. 18, 2025.

* cited by examiner

FOOTWEAR UPPER WITH COMPONENTS FOR EASIER FOOT INSERTION

INCORPORATION BY REFERENCE TO RELATED APPLICATIONS

This application incorporates by reference in its entirety the International Application No. PCT/US2022/46726, filed on Oct. 14, 2022.

TECHNICAL FIELD

The present disclosure generally relates to footwear and in particular heel counter and tensioning system for easier entry of the wearer's foot into the shoe.

BRIEF SUMMARY OF DISCLOSURE

Aspects of this invention relate to an article of footwear that has a structure capable of easier foot insertion coupled with components that aid in hands free securement of the foot after foot insertion. The components may include a heel cup configured to have a foot receiving portion having a crested portion, the crested portion allowing the foot to have ease in entry into the shoe opening. Further to this embodiment, the heel cup may have a foam layer that is adjacent to an inner surface of the heel cup and may be thicker at the upper portion of the heel cup near and/or adjacent to the crested portion. Further to this embodiment, the heel cup may be used in combination with a tensioning system having at least an adjustable lace and fixed lace. The fixed lace provides sufficient elasticity to allow the foot ease in entry and removal while also providing sufficient tension to secure the foot without the wearer having to use the wearer's hands to manipulate the fixed lace. The adjustable lace may be adjusted to the wearer's preferences of elasticity and tension which may be based on the desired securement, activity, or handsfree operation.

In one aspect of the invention, a heel cup may be uniformly molded with an upper portion, midportion, and lower portion, and the upper portion has a smaller mediolateral width than the midportion. The midportion and lower portion may form a concave structure configured to receive the heel.

The upper portion of the heel cup has an overall downward incline with a first angle relative to a vertical line that is normal to a level plane of the floor with the highest point(s) extending rearward and away from an opening of the shoe. The upper portion has an upper surface that may have a convex curved portion along the rearmost section of the heel cup such that a heel bottom is directed to slide upon insertion of the foot. The convex curved portion may further curve downward and inflect to form the concave structure at the midportion and lower portion.

The upper portion of the heel cup may extend above the medial and the lateral collar portions of the upper. The upper portion may have a horizontal curvature that is relatively coextensive to the mediolateral curvature of the heel portion of the upper. The length of the horizontal curvature may be configured to receive and at least partially cup part of the bottom of the heel as the foot is inserted into the shoe.

The upper portion of the heel cup has a first configuration in its native state and is capable of distorting into a second configuration under a load of a user's foot when the user is donning the footwear. In the second configuration, at least part of the upper portion is lowered relative to the first configuration and the upper portion is capable of returning to the first configuration after the load of the user's foot is removed. The midportion may include a peripheral portion having a first thickness and a central portion having a second thickness, and the second thickness is less than the first thickness.

The heel cup may be formed of a rigid structure capable of not being substantially compressed upon insertion of the foot. In such configurations, the upper may have elastic portions that allow the upper to stretch as the foot is inserted into the shoe. As the foot is inserted, a pressure is applied to the upper portion of the heel cup. If the heel cup is substantially rigid, the pressure may push the heel cup rearward. The heel cup may be used in combination 20) with elastic portions in the upper to allow the heel cup to move rearward during foot insertion. Following foot insertion, the rigid heel cup may return to its original position to secure the foot within the shoe and support of the foot during use.

The upper portion of the heel cup may also be compressed during foot insertion wherein the upper portion may have a first configuration in its native state and is capable of distorting into a second configuration under a load of a user's foot when the user is donning the footwear. The heel cup may return to the first configuration after the load of the user's foot is removed. In the second configuration, at least part of the upper portion is lowered relative to the first configuration and the upper portion may return to the first configuration after the load of the user's foot is removed. The midportion may include a peripheral portion having a first thickness and a central portion having a second thickness, and the second thickness is less than the first thickness.

Further to this embodiment, in the first configuration, the upper portion has a downward incline with a first angle relative to a vertical line that is normal to a horizontal surface of the floor, and the upper portion in the second configuration has an incline with a second angle greater than the first angle. Additionally, in the second configuration, a lower region of a central portion of the heel cup extends outward in a direction away from the shoe opening that causes the shoe opening to widen along the mediolateral direction.

An interior foam layer may be a flat material lining covering at least a portion of an inner surface of the heel cup: or the foam layer may include regions with additional padding: foam layer functions to provide cushion and comfort to the foot and may assist in securing the foot within the upper after foot insertion. In one embodiment, the foam layer may be protruding and elongated with a rounded front facing surface. The foam layer may form a U-shaped padding around the region of the heel cup such that the padding contacts the foot above the calcaneus region of the foot and around the rear portion of the subtalar joint or at least a portion of the topmost region of the foot receiving shoe opening. The foam layer may extend at least partially around and over the foot receiving shoe opening. The foam layer may be compressed by the user's heel during foot insertion in an unexpanded or first partially compressed state. After the foot is inserted into the shoe, the foam layer may be expanded to its uncompressed state or a second partially compressed state wherein the second partially compressed state is less compressed than the first partially compressed state. Such a configuration enables the interior foam layer to exert sufficient pressure on or around the user's ankle in order to secure the foot into the shoe. For example, the calcaneus portion of foot may not be easily removed from the shoe during such activities as walking or running. The foam layer may have a tapered, or flattened dimension in regions where less padding is needed such as regions extending where the 20) foam layer exerts pressure around the ankle of the foot.

In another aspect of the invention, a heel cup design may introduce distinct regions to enhance flexibility and support during shoe donning. The upper portion of the heel cup features medial and lateral elevated points flanking a recessed point along the medial line, forming medial and lateral crest regions surrounding a trough region. These crest regions are thinner and more flexible than the trough region, providing dynamic guidance and aiding in its centering the foot when a user dons the shoe. A tapering thickness, particularly at the crest regions, further enhances flexibility. The trough region maintains a slightly reduced flexibility to facilitate heel centering.

The heel cup's dimensions, defined by height and curved width, vary based on the footwear type and customization needs. The vertical cross-sections of the heel cup display concave curvatures, with depths varying along different regions.

In another aspect of the invention, the heel cup is integrated within the upper layers, including a foam layer for cushioning and support. The heel cup may be bonded to adjacent layers, such as textile or leather materials, facilitating structural integrity and stability. Multiple layers may overlap in strategic regions, contributing to the overall functionality and durability of the shoe.

In another aspect of the invention, a lacing system has distinct fastening regions within the shoe tongue or vamp, facilitating adjustment for hands-free donning and doffing of the wearer's foot on the shoe. In one exemplary configuration, at least two tensioning systems include an adjustable lace and a fixed lace. These may be located along the instep or collar of shoe at any location, such as an upper and lower laces. In an exemplary configuration, a lower lace may be fixed and may include, but is not limited to, a continuous lace, wire, and/or strap, while an upper lace secures an upper fastening region with an adjustable lace, wire, and/or strap or any other fastener known in the art. In the case of laces, a central lace loop and upper tongue loop may facilitate anchoring of the tongue and alignment of the tongue along the instep to reduce the tongue from folding or falling into the cavity of the shoe.

BRIEF DESCRIPTION OF THE DRAWINGS

By way of example only, selected embodiments and aspects of the present invention are described below. Each description refers to a figure ("FIG.") which shows the described matter. Some figures shown in drawings or photographs that accompany this specification may be for footwear that is for either the left or right foot. Each figure includes one or more identifiers for one or more part(s) or elements(s) of the invention.

Various embodiments are described with reference to the drawings, in which.

DETAILED DESCRIPTION

Figure 1:
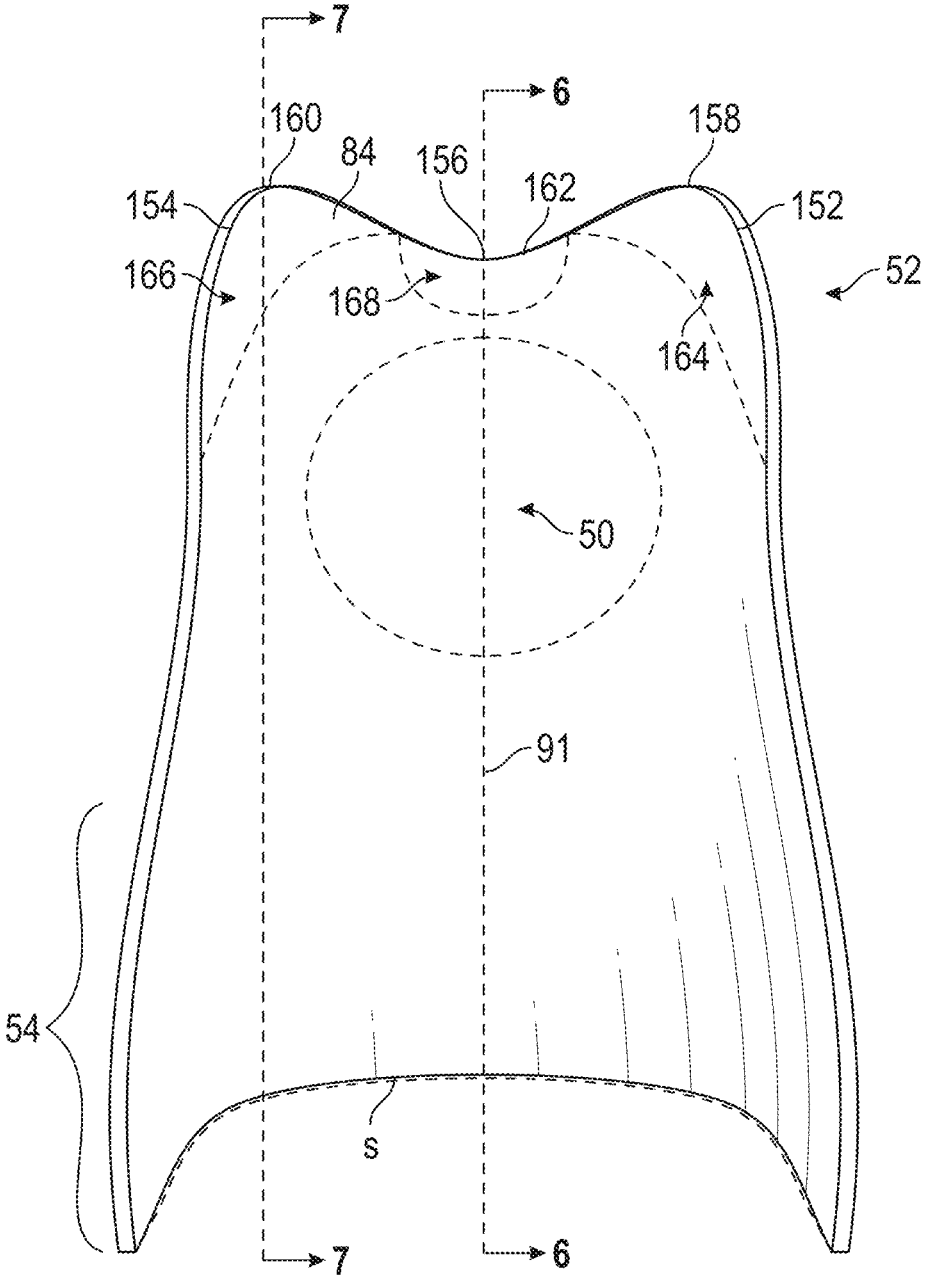
FIG. 1 is a front view of a heel cup.
Figure 2:
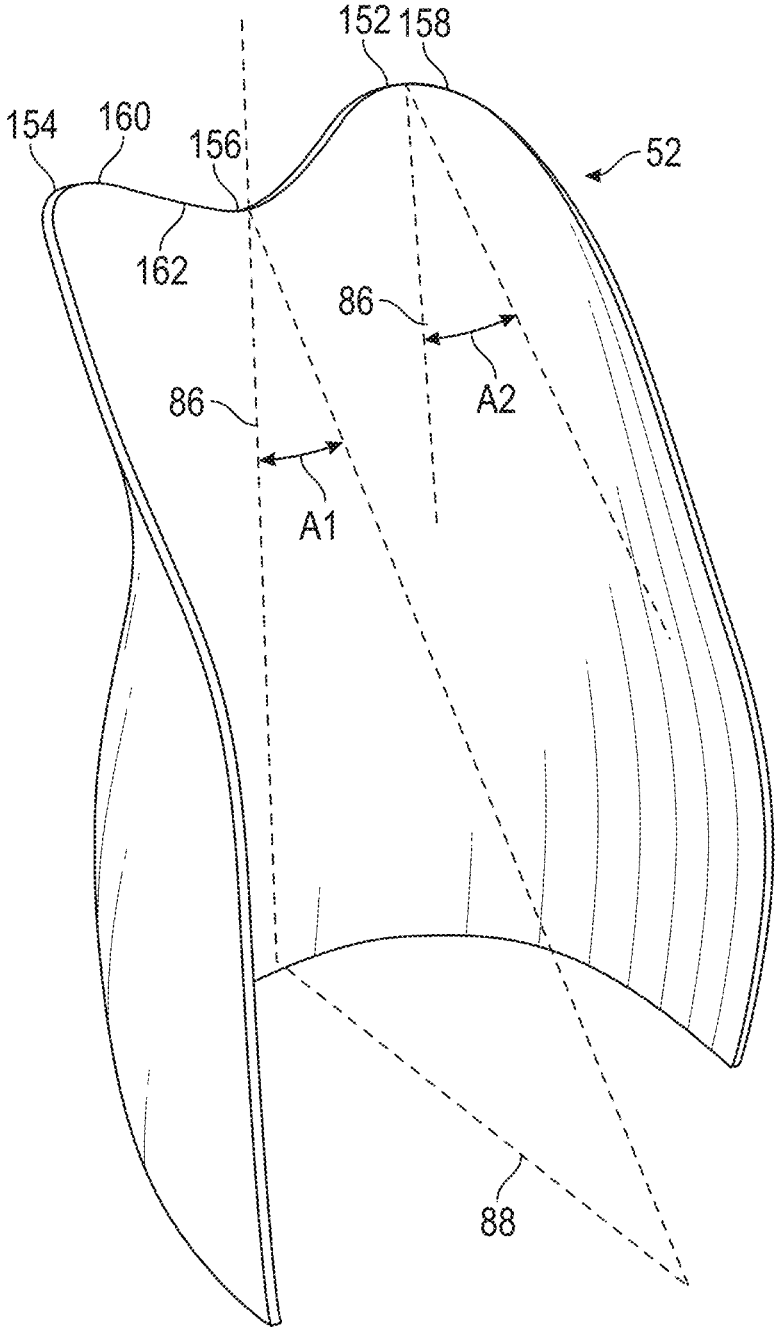
FIG. 2 is a perspective view of the heel cup of FIG. 1.
Figure 3:
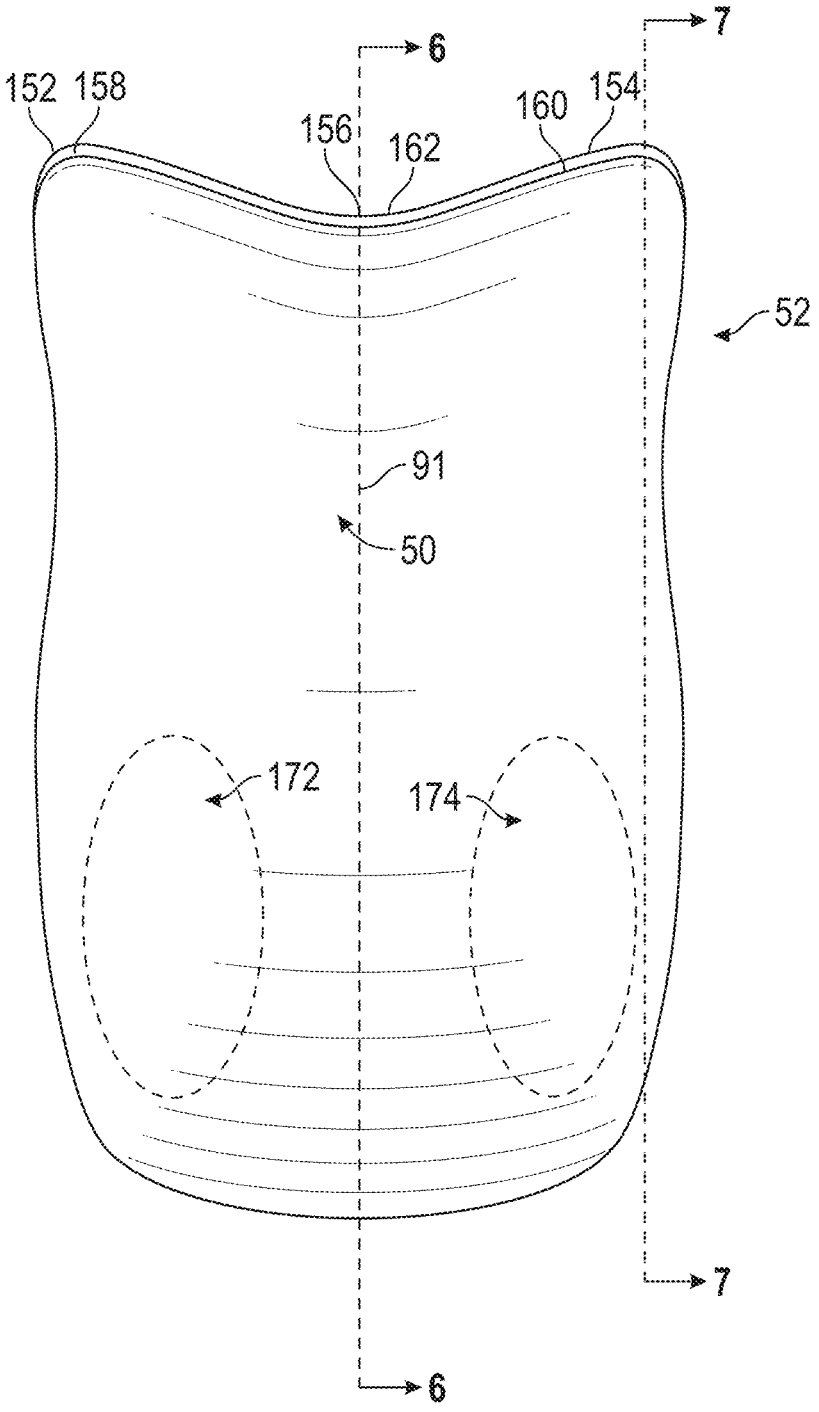
FIG. 3 is a rear view of the heel cup of FIG. 1.

Inventive components of an article of footwear, shoe, and methods of manufacturer thereof are disclosed herein and comprises various embodiments.

In some embodiments, a shoe may comprise a sole and an upper. The sole may comprise an outsole, a midsole, and/or an integrally formed outsole and midsole. The upper may comprise any of the following components along a toe box, a vamp, a tongue, a medial quarter, a lateral quarter, and a heel counter. The shoe has a forefoot portion, a rear portion, a medial side and a lateral side. The upper may comprise an exterior layer, interior layers or interior structure, and/or an inner lining. The upper may form a shoe opening that is capable of receiving a user's foot when the user is donning the shoe. The upper may comprise a heel counter with a heel cup and/or a fastening system. These regions are defined conceptually rather than as discrete, physically demarcated sections. As such, the figures of the present application depict approximate locations of these regions and portions.

In other embodiments, a boot or a shoe with a raised ankle collar may comprise any of the elements of a shoe along with an extended ankle portion of the upper wherein the ankle cuff is positioned vertically higher up the wearer's leg. The heel cup may be vertically extended along the upper to the height raised ankle cuff. The fastening system may be vertically extended along the instep of the upper to the height of the raised ankle cuff.

In other embodiments such as sandal or footwear having at least one or more exposed regions of the foot, the upper may comprise at the very least a heel cup and fastening system.

The heel counter or rear portion of the upper may comprise a heel structure that enables easier insertion of the foot into the shoe opening. In one exemplary embodiment, the heel structure may be a heel cup. The upper portion of the heel cup has an overall downward incline with a first angle relative to a vertical line that is normal to a level plane of the floor with the highest portion extending rearward. The upper portion has an upper surface that may have a convex curved portion along the rearmost vertical cross-section of the heel cup such that a heel bottom is directed to slide upon insertion of the foot. The convex curved portion may further curve downward and inflect to form the concave structure at a midportion and at a lower portion of the heel cup. The upper portion, midportion, and lower portion may be uniformly molded as a continuous structure that cups around heel and at least a rear portion of the ankle. The medial and lateral side portions of the heel cup may be sloped downward towards the top surface of the footbed or sole.

In another exemplary embodiment, the heel structure may be an arched heel piece. The upper center portion of the arched heel piece has an overall downward incline with a first angle relative to a vertical line that is normal to a level plane of the floor with the highest portion extending rearward. The upper portion has an upper surface that may have a convex curved portion along the rearmost vertical cross-section of the heel cup such that a heel bottom is directed to slide upon insertion of the foot. The convex curved portion may further curve downward to the bottom edge of the upper center portion of the arched heel piece. The medial and lateral side arms of the arched heel piece may extend from the upper center portion and slope downward towards the top surface of the footbed or sole along the forward direction of the shoe.

The heel cup may be formed of a rigid structure that is not substantially compressed under the load during donning of the shoe. In such a configuration, the upper may have elastic portions that allow the upper to stretch as the foot is inserted into the shoe. As the foot is inserted, a pressure is applied to the upper portion of the heel cup. With a substantially rigid heel cup under the load of the foot exerted during the donning of the shoe, the pressure may push the heel cup rearward but not by bending or compression of the heel cup. Rather, the heel cup may be used in combination with elastic portions in the upper to allow portions of the heel cup to move or be tilted rearward during foot insertion. Following foot insertion, the rigid heel cup may return to its original position to secure the foot within the shoe as the elastic portion returns to its at least partially its unstretched state, and the heel cup is able to provide support to the foot during use.

In another embodiment, the heel cup may be formed of a rigid structure that is not substantially compressed under the load during donning of the shoe. In such a configuration, the heel cup may have a compressible layer that is located around the rear ankle portion and covers portions of upper portions and/or midportions of the heel structure. The compressible layer may be compressed during the foot insertion and foot removal. The compressible layer may expand after foot insertion and secure or enhance securement of the foot.

The heel cup may support both the ease in foot insertion and removal of the foot. The heel counter or rear portion of the upper may allow for a transient widening of the opening of the shoe configured to receive the foot when the user is donning or removing the shoe. The widening of the shoe opening may be initiated by the user placing a load on the heel counter or rear portion of the upper that may be exerted by the user's foot with minimal to no assistance by the user's hands. In one exemplary embodiment of the invention, the heel counter may be compressible when placed under sufficient load and return to its uncompressed stated. The heel counter may have a heel cup that lowers or has compressible layers that compress under load, thereby 20) widening the shoe opening and allowing easier insertion of the user's foot. Once a foot is inserted into the shoe, the heel counter may have a compressible layer, such as a foam layer or component, that may further secure or enhance securement of the foot during user's normal wear of the shoe. This action may not require the use of hands.

Once a foot is inserted into the shoe, the heel counter may have a compressible layer, such as a foam component, that secures or enhances securement of the foot during user's normal wear of the shoe.

Heel Cup and Compressible Layer. Referring to the exemplary embodiment of FIGS. 1-12, the heel cup 52 may have a shape corresponding to a profile resembling a pear-like shape. The heel cup may have a mediolateral width near the heel cup collar 84 that is less than the mediolateral width of the lower portion 54

The heel cup 52, as shown in FIGS. 1-12, when observed from the rear, may also have the upper portion 64 of the heel cup 52 comprises a medial elevated point 152 and a lateral elevated point 154 situated on either side of a recessed point 156 along the median line 91 of the heel cup separating the medial and lateral sides of the heel cup. These medial elevated point 152 is located on a medial crest 158 in a medial crest region 164, and the lateral elevated point 154 is located on a lateral crest 160 in a lateral crest region 166. The medial crest 158 and lateral crest 160 flank the recessed point 156 located on trough 162 in a trough region 168. In the exemplary embodiment the recessed point 156 is located at the median line 91. In some embodiments, the height of the medial elevated point 152 and the lateral elevated point 153 are the same. However, in other embodiments, the height of the medial elevated point 152 and the lateral elevated point 153 may differ. For example, the medial elevated point may be higher than the lateral elevated point, or vice versa. Additionally, in some embodiments, the trough may be offset medially or laterally from the median line, and the recessed point may or may not be centered on the trough.

The inner wall 66 of the upper portion 64 of the heel cup may have a downward incline of between 0 to 90 degrees relative to a vertical line 86 that is normal to the level plane of the floor 88. The inner wall 66 of the upper portion 64 of the heel cup 52 may have a convex curvature facing toward the shoe opening 48. In the exemplary embodiment, the top portion of the convex curvature at the medial line 91 has the downward incline A1 of approximately 30 degrees. The lower portion of the convex curvature extends just above the portion of the heel cup 52 that receives the heel. The lower portion of the convex curvature may have a downward incline less than the downward incline of A1 and gradually decreases as it approaches an incline equal to the vertical line 86. The heel cup 52 has a concave curvature that surrounds the rear portion of the heel. The medial and lateral sides of the heel cup 52 may also extend and form support of part of the quarter and even as far as the vamp. Along the rearmost vertical axis of the heel cup, the heel cup has an approximate S-wave configuration. The approximate S-wave vertical configuration may continue along the medial and lateral sides and becomes less as the vertical height of the heel cup tapers downward to the base line [add number] of the heel cup.

The inner wall 66 of the medial crest region 164 and lateral crest region 166 of the heel cup 52 exhibits a downward incline A2 ranging from 0 to 90 degrees relative to a vertical line 86 perpendicular to a level plane of the floor 88. The inner wall 66 may have a convex curvature directed towards the shoe opening. The outer wall, conversely, may exhibit a concave curvature directed toward the shoe opening 48. Adjacent to at least one of the medial elevated point 152 and lateral elevated point 154, where the medial crest 158 and lateral crest 154 reach the highest elevation on a vertical line 86 perpendicular to a level plane of the floor 88, there is a downward incline A2 of approximately 47 degrees. Extending downward along the medial crest region 164 or lateral crest region 166 the downward incline A2 gradually decreases as it approaches a downward incline equal to a vertical line 86 perpendicular to a level plane of the floor 88. Extending downward from the convex curvature of the inner wall, the inner wall may have a concave curvature extending to the bottom of the heel cup. The outer wall opposite the concave curvature of the inner wall, conversely, may exhibit a convex curvature on the outer wall. In other embodiments, the downward incline adjacent to the medial elevated point may differ from the downward incline adjacent to the lateral elevated point.

Adjacent to the recessed point 156 of the trough 162, the inner wall of the heel cup 52 has a downward incline A1 ranging from 0 to 90 degrees in relation to a vertical line 86 perpendicular to a level plane of the floor 88. This inner wall has a convex curvature directed towards the shoe opening. The outer wall opposite the convex curvature, conversely, may exhibit a concave curvature directed away the shoe opening. In the exemplary embodiment, at the top portion of the convex curvature, adjacent to the recessed point 156 of the trough 162, the inner wall has a downward incline A1 of approximately 30 degrees. Extending downward from the recessed point 156 the inner wall may have a downward incline less than the downward incline of A1, and the downward incline A1 gradually decreases as it approaches a downward incline equal to a vertical line 86 perpendicular to a level plane of the floor 88. Extending downward from the convex curvature of the inner wall, the inner wall may have a concave curvature extending to the bottom of the heel cup. The outer wall opposite the concave curvature of the inner wall, conversely, may exhibit a convex curvature on the outer wall.

The thickness of the heel cup may be reduced at various locations or uniform. The top edge line 68 may have a tapering of the inner surface of the heel cup 52 and outer surface of the heel cup 52 at least along a portion of top edge line 68. See FIGS. 6 and 12. The heel cup 52 may also have increased thickness T1 along the other perimeter edges, such as 2 to 3 mm. In another exemplary embodiment, the thickness T1 may be reduced in certain areas such as in a more central portion of the heel cup. The varying thickness may provide portions of greater flexibility to the heel cup 52 which may aid when donning or removing the shoe 12. In one embodiment, the thickness T1 of the heel cup 52 may decrease gradually from a peripheral portion 70 forming an area at the periphery of the heel cup 52 toward the central portion 50 of the mid-portion 58. The minimum thickness T1 in the central portion 50 of the mid-portion 58 may be approximately, but not limited to ¼ to ⅙ the thickness relative to the thickest portions at the periphery of heel cup 52, such as 0.5 to 1 mm. The reduced thickness T1 of the central region of the mid-portion 58 may allow for the heel cup 52 to bend, fold or compress under the load of the foot exerted during the donning of the shoe. The bending, folding, or compression may result in widening the opening of the shoe in either longitudinal or latitudinal direction to allow the foot to enter the shoe with greater ease. Further to this embodiment, the upper portion may have sections that are thinner portions that taper from a thicker region of the heel cup to a portion located along the top edge line. These portions may further allow at least sections of the upper portion from folding rearward and away from the shoe opening during the donning of the shoe.

The thickness T1 at the medial crest region 164 and lateral crest region 166 is thinner in relation to the trough region 168. As a result, the medial crest region 164 and lateral crest region 166 are more flexible than the trough region 168. The difference of flexibility among these regions allows the medial crest region 164 and lateral crest region 166 to adapt dynamically to the user's heel when donning the shoe. The trough region 168, while still flexible, has a greater thickness than the medial crest region 164 and lateral crest region 166, and therefore, the trough region 168 has slightly reduced relative flexibility. As a result, the trough region 168 provides more resistance to the user's heel when donning the shoe 12 and aids in the reliable centering of the heel.

The medial crest region 164 and the lateral crest region 166 may have the same or differing flexibilities with respect to one another. This variation in flexibility can be tailored based on the intended use of the shoe, the materials used in the construction of the heel cup, and the desired comfort and support characteristics. In one non-limiting way to vary the flexibility, it can be achieved by varying the thickness of these regions. In one embodiment, the medial crest region 164 can be made more flexible than the lateral crest region 166 to provide enhanced comfort on the medial side of the foot, or vice versa, depending on specific footwear requirements. In another embodiment, the medial crest region 164 and lateral crest region 166 have equal flexibility for balanced support.

The perimeter of the heel cup may generally exhibit tapering 170 of the inner and outer surfaces of the heel cup. The tapering 170 is characterized by a gradual reduction in thickness towards the edges of the heel cup. However, in one exemplary embodiment, shown in FIG. 7, the center of the trough 162 is not tapered along the topline edge 68. The medial crest 158 and lateral crest 160 is tapered along the topline edge 68. The topline edge 68 has the greatest thickness T1 at the location of the recessed point, where there is no tapering 170 of the inner and outer surfaces of the heel cup. The thickness T1 of the topline edge 68 is gradually reduced as it extends in a medial direction from the recessed point 156 toward the medial elevated point 152. The thickness T1 of the topline edge 68 is gradually reduced as it extends in a lateral direction from the recessed point 156 toward the lateral elevated point 154. In the medial crest region 164 and extending toward the top line edge 68 at the medial crest, there is a gradual tapering 170 of thickness T1, which is more gradual as compared to the tapering 170 toward the perimeter of other portions of the heel cup. Consequently, the medial crest region 164 and lateral crest region 166 exhibit greater flexibility as they approach the top line edge 68, and also exhibit greater flexibility away from the trough 162.

In one embodiment, the thickness T1 of the heel cup 52 may decrease gradually from a peripheral portion 70 forming an area at the periphery of the heel cup 52 toward the central portion or region 50 of the mid-portion 58. The minimum thickness in the central region 50 of the mid-portion 58 may be approximately, but not limited to roughly ½ the thickness relative to the thickest portions at the periphery of heel cup 52. Due to the gradual tapering 170 of thickness of the medial crest region 164 and lateral crest region 166 extending toward the topline edge, the medial crest region 164 and lateral crest region 166 have variable thickness, and portions of the medial crest region 164 and lateral crest region 166 have thicknesses less than the minimum thickness in the central region 50.

In the exemplary embodiment, a maximum thickness at the periphery of heel cup 52 may be located in the lower portion of the heel cup 52, on at least one of the medial side of the heel cup 52 in a medial flank portion 172, between the median line 91 of the heel cup 52 and the medial edge, and the lateral side of the heel cup 52 in a lateral flank portion 174, between the median line 91 of the heel cup and the lateral edge.

The heel cup 52 is capable of distortion from a first configuration in its native state, to a second configuration under a load of a user's foot when the user is donning the footwear. The reduced thickness T1 of the heel cup 52 in the medial crest region 164 and lateral crest region 166 and central portion 50 of the mid-portion 58 may allow for the heel cup 52 to compress into a second configuration under sufficient load. The regions of reduced thickness T1 of the heel cup may provide increased flexibility and bending of the heel cup 52 which provides the necessary compressibility under the load of a user's foot such as during the donning of a shoe 12. For example, the heel cup 52 may be partially compressed such that the upper portion 64 and/or mid-portion 58 of the heel cup 52 is lowered sufficiently to allow the insertion of the user's foot. Once the user's foot is inserted into the shoe 12, the heel cup 52 may return to its first (uncompressed) configuration.

The medial crest 158 and lateral crest 160 of the heel cup 52 facilitate the alignment and positioning of the user's heel when donning the shoe. As the foot is inserted into the shoe, medial crest 158 and lateral crest 160 aid in directing the heel towards the center of the shoe. The medial crest 158 and lateral crest 160 may also function to cradle and support the Achilles tendon, mitigating potential discomfort. The medial crest 158 and lateral crest 160 may also flare outward, serving to aid in preventing the forefoot from collapsing the top of the heel cup into the shoe opening when the user dons the shoe. The mediolateral widening of the shoe opening 48 allows easier entry such as easier insertion of the forefoot portion of the user's foot. The widening may be less or more depending on the size of the shoe and the flexibility of the heel cup.

The medial crest 158 and lateral crest 160 of the heel cup 52 facilitate the alignment and positioning of the user's heel when donning the shoe. As the foot is inserted into the shoe, medial crest 158 and lateral crest 160 aid in directing the heel towards the center of the shoe. The medial crest 158 and lateral crest 160 may also function to cradle and support the Achilles tendon, mitigating potential discomfort. The medial crest 158 and lateral crest 160 may also flare outward, serving to aid in preventing the forefoot from collapsing the top of the heel cup into the shoe opening when the user dons the shoe. The mediolateral widening of the shoe opening 48 allows easier entry such as easier insertion of the forefoot portion of the user's foot. The widening may be less or more depending on the size of the shoe and the flexibility of the heel cup.

The heel cup may be dimensionally defined by its height 176, measured along a vertical line 86 from the bottom of the heel cup to the most elevated point at the top of the heel cup. The heel cup may be dimensionally defined by its curved width S, measured as an arc length along a mediolateral direction of the heel cup 52. In the exemplary embodiments, the curved width is measured at the bottom of the heel cup. The ratio of height to curved width (measured at the bottom of the heel cup) is typically between 0.4 and 1 but may be lesser or greater and can vary depending on customization to the user's foot and the intended purpose of the shoe. In the exemplary embodiment, specifically when employed in a boot, the height 176 is roughly 11 cm and the curved width S is roughly 14.2 cm, conferring a ratio of roughly 0.8. In another exemplary embodiment, specifically when employed in a sports shoe, the height 176 is roughly 6.5 cm and the curved width S is roughly 12.5 cm, conferring a ratio of roughly 0.5. The curved width S of the heel cup may be greatest where it is near to or intersecting AL. In one exemplary embodiment where the curved width S measured at the bottom of the heel cup is roughly 14.2 cm, the curved width S measured near to or intersecting AL is roughly 15 cm, conferring a height to curved width ratio of roughly 0.7.

Figure 6:
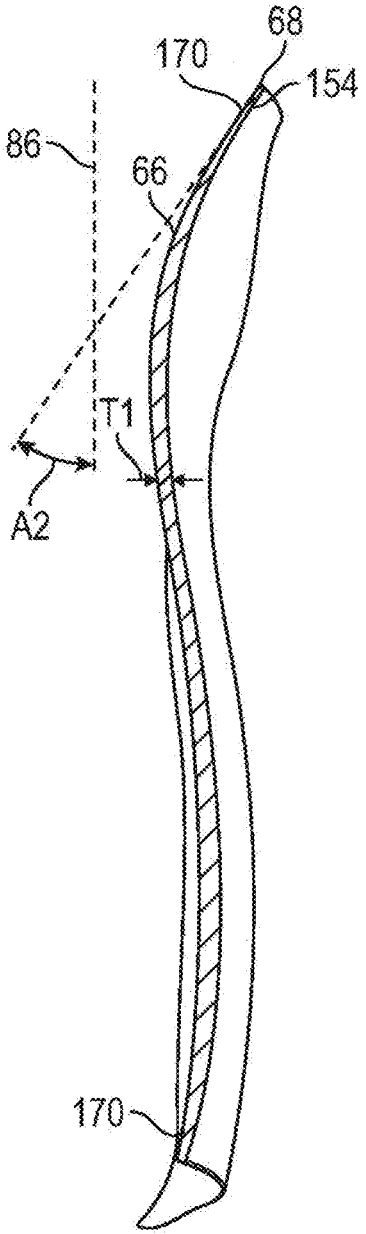
FIG. 6 is a schematic illustration of a cross-section of the heel cup of FIG. 3 taken at lines 6-6.
Figure 7:
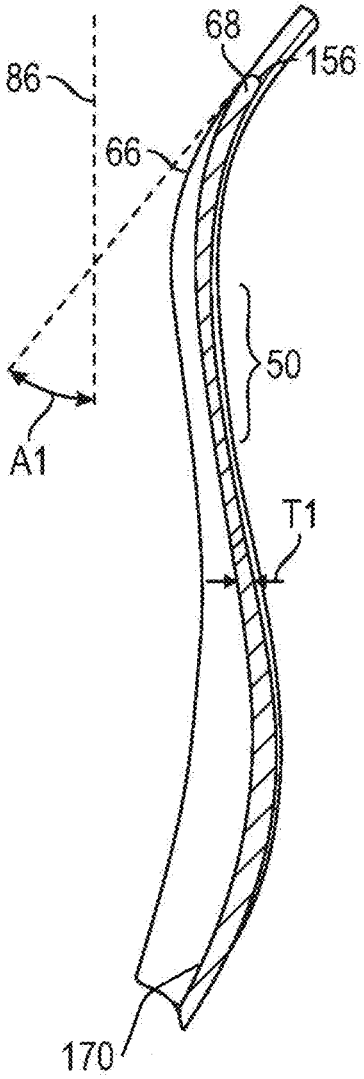
FIG. 7 is a schematic illustration of a cross-section of the heel cup of FIG. 3 taken at lines 7-7.
Figure 8:
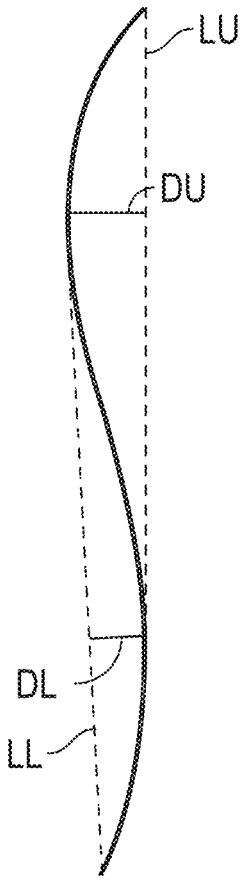
FIG. 8 is a schematic illustration arc lengths of the rear wall of the heel cup of FIG. 3 taken at lines 6-6.
Figure 9:
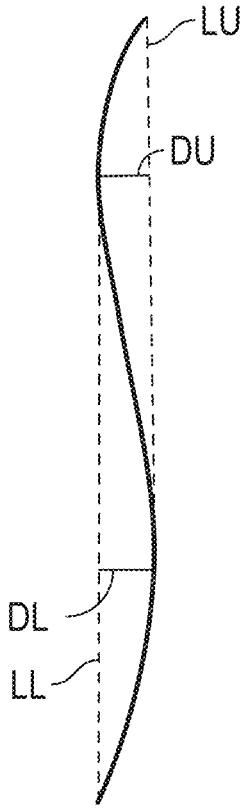
FIG. 9 is a schematic illustration arc lengths of the rear wall of the heel cup of FIG. 3 taken at lines 7-7.
Figure 10:
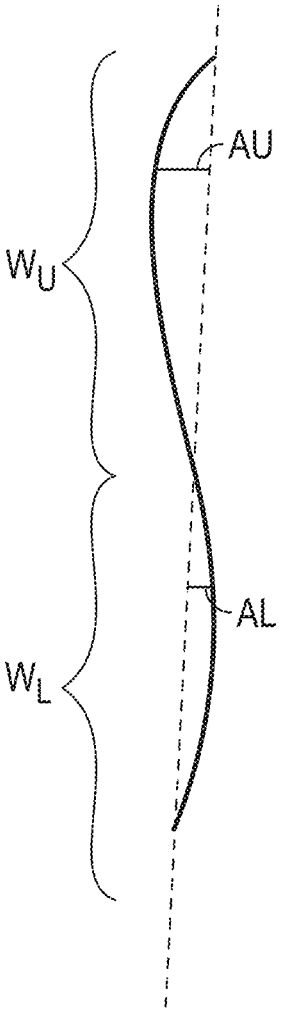
FIG. 10 is a schematic illustration arc lengths of the rear wall of the heel cup of FIG. 3 taken at lines 6-6.

In an exemplary embodiment. FIG. 6 depicts a vertical cross-section of the heel cup 52, taken at a line intersecting the lateral elevated point 154 on the lateral crest 160, and FIG. 7 depicts the rear wall at that cross-section and approximates the shape of an S wave. In the exemplary embodiment, the WU of this section is approximately 1.4 times that of the WL. The AU is approximately double that of the AL. In one possible embodiment, the WU is approximately 6.4 centimeters (cm), and the WL is approximately 4.6 cm. The AU is roughly 8 millimeters (mm), and the AL is roughly 4 mm.

Figure 11:
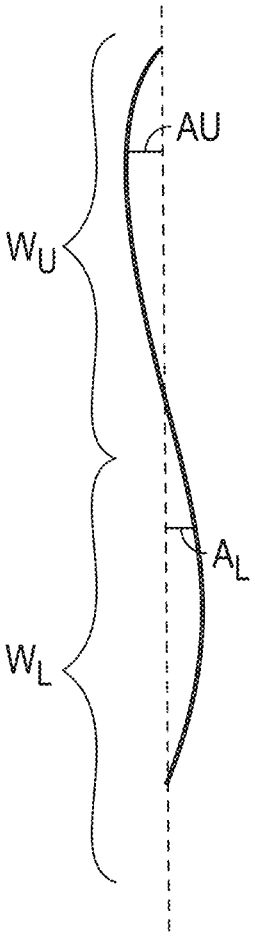
FIG. 11 is a schematic illustration arc lengths of the rear wall of the heel cup of FIG. 3 taken at lines 7-7.

Further to the exemplary embodiment. FIG. 7 depicts a vertical cross-section of the heel cup 52, taken at the median line 91, and FIG. 11 depicts the rear wall at that cross-section and approximates the shape of an S wave. In the exemplary embodiment, the WU of this section is approximately 0.8 times that of the WL. The AU is approximately ⅔ that of the AL. In the exemplary embodiment, the WU is approximately 4.5 cm, and the WL is approximately 5.6 cm. The AU is roughly 4 mm, and the AL is roughly 6 mm.

As described above, the inner and outer walls of the heel cup may feature concavities along a vertical cross-section of the heel cup, the depths of which may play role in the functionality and shape of the different configurations of the heel cup. The radius of curvature along the concavities may vary and may not adhere to a circular shape. The depth of a concavity may simply be measured by the amplitude AU or AL as described above. On a vertical cross-section of the heel cup 52, taken at the median line 91, the lower cavity has a greater depth than the upper cavity. On a vertical cross-section of the heel cup 52, taken at a line intersecting the lateral elevated point 154 on the lateral crest 160, the upper cavity has a greater depth than the lower cavity.

A tangential depth D of a concavity can be measured as the greatest perpendicular distance from the reference line L, measured from an end of the "S" shape to the tangential point on a convexity located on the same side as that which the end of the "S" shape extends. On a vertical cross-section of the heel cup 52, taken at the median line 91, the lower cavity has a greater tangential depth D than the upper cavity. An upper concavity depth (DU) measured from an upper reference line (LU) of the upper arc of the S wave may be different than a lower concavity depth (DL) measured from a lower reference line (LL) of the lower arc of the S wave. Along a vertical cross-section of the heel cup 52, taken at a line intersecting the lateral elevated point 154 on the lateral crest 160, the upper cavity has a greater tangential depth D than the lower cavity. Along the vertical cross-section of the heel cup, taken through the trough region, the lower concavity is deeper than the upper concavity. Along a vertical cross-section of the heel cup, taken through a medial crest or lateral crest region, the upper concavity is deeper than the lower concavity.

The heel cup may be situated within layers of the upper. In one exemplary embodiment, specifically when employed in a boot, a base layer constitutes the innermost layer of the upper. Separating the base layer from the heel cup may be one or more layers of foam, which serve as additional cushioning for comfort and aid in securing the heel inside the shoe. Rearward of the upper portion 64 of the heel cup 52 may lie an exterior material layer of the upper, such as a textile layer. Rearward of the mid portion 58 of the heel cup 52, there may be an exterior layer of the same or a different material, such as natural or synthetic leather. The lower portion 54 of the heel cup 52 may have at least one additional layer, such as natural or synthetic leather which aids in supporting the heel cup 52 at this location. This layer may form a rearmost counter 214 of the upper. Multiple upper layers may overlap in any of these regions. The lower portion 54 of the heel cup 52 may also receive additional support from a portion of the midsole which rises above and surrounds the lower surface of the user's heel. The upper may include a heel tab 216 for optional hand-assisted donning or doffing.

Further to the exemplary embodiment, the heel cup 52 may be bonded to at least one layer adjacent to the heel cup 52. The heel cup 52 may be bonded to an intermediate textile layer, such as one located on the rear wall of the lower portion 54 of the heel cup 52, and which may aid in securing the heel cup to adjacent layers contacting the intermediate textile layer.

In an alternate embodiment, the heel cup may have a uniform thickness or may be sufficiently rigid without any bending, folding, or compression within any portions of the heel cup under the load of foot exerted during the donning of the shoe. During the donning of the shoe, the heel cup allows sliding of the heel into the shoe along a convex curvature on the inner surface of the rearward portion. The heel cup may be used in combination with elastic material positioned between the heel cup and the instep of the shoe along the medial and lateral sides of the upper. With a substantially rigid heel cup under the load of the foot exerted during the donning of the shoe, the pressure may push the heel cup rearward and the heel cup may be displaced rearward by the stretching of the elastic material. The heel cup may not bend or fold during this action, but only have at least portions of the heel cup be displaced or tilted rearward. Following foot insertion, the rigid heel cup may return to its original position to secure the foot within the shoe to as the elastic portion returns to its at least partially its unstretched state.

In an alternate embodiment, the thickness T1 may be reduced across the entire mediolateral portion or in multiple regions such as various regions in the mid-portion 58 and/or regions of the upper portion 64. The thinner regions may provide increased flexibility and bending of the heel cup 52 which provides compressibility under the load of a user's foot exhibited during the donning of a shoe 12. Such compression may allow the upper portion 64 and/or the mid-portion 58 of the heel cup 52 to move rearward and/or widen the shoe opening 48 to allow easier entry of the foot. The heel cup 52 is capable of distortion from a first configuration in its native state to a second configuration under a load of a user's foot when the user is donning the footwear. For example, the heel cup 52 may be partially compressed or folded such that the upper portion 64 and/or mid-portion 58 of the heel cup 52 is lowered sufficiently to allow the insertion of the user's foot. See for example FIGS. 4B and 4D. The lowering may cause the heel cup to fold and move rearward to widen the shoe opening or to cause the sides of the heel cup to move more outward thereby widening the heel cup in the mediolateral direction. Once the user's foot is inserted into the shoe 12, the heel cup 52 may return to its uncompressed or unfolded configuration.

Figure 4A:
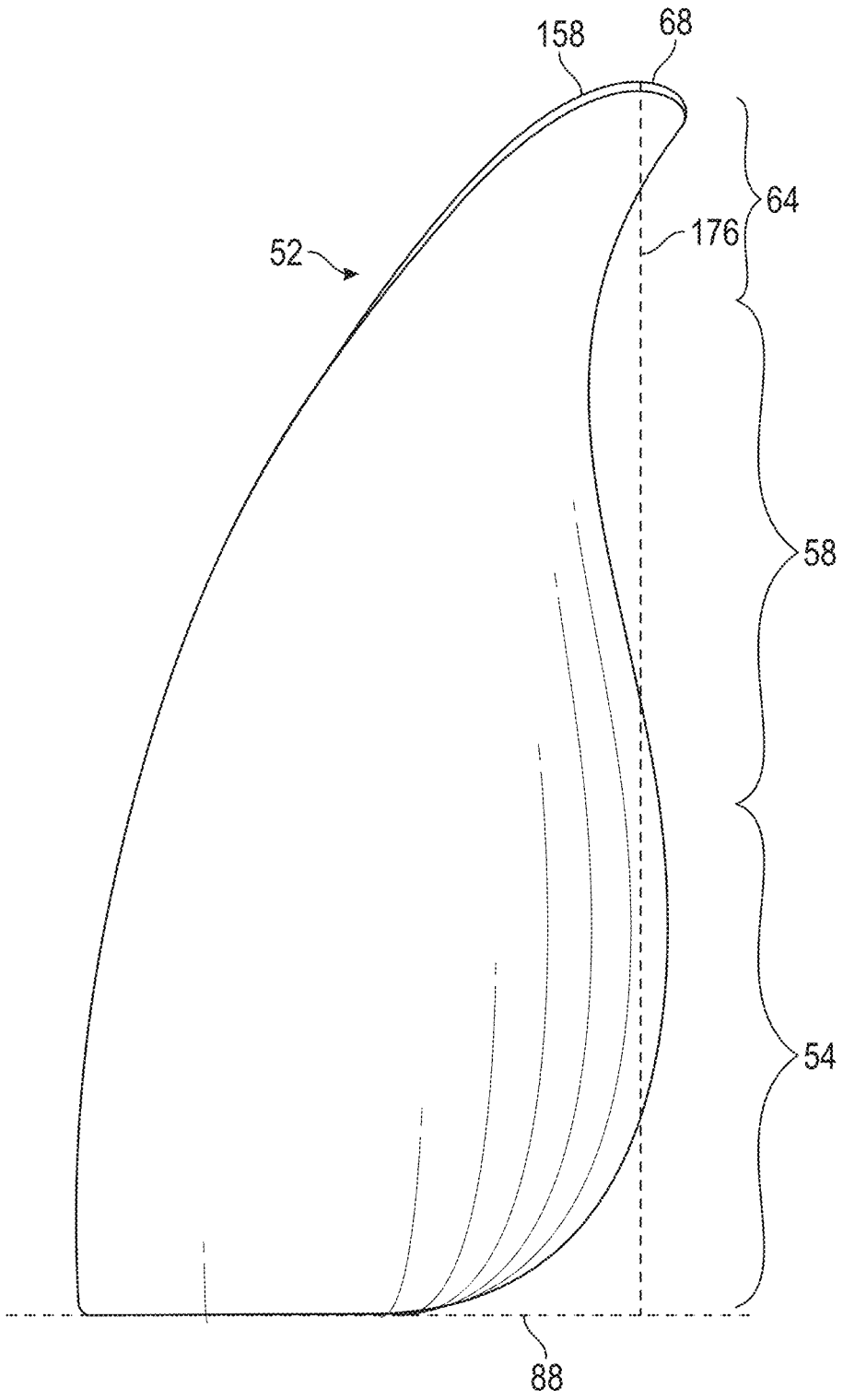
FIG. 4A is a profile view of the heel cup of FIG. 1.
Figure 4B:
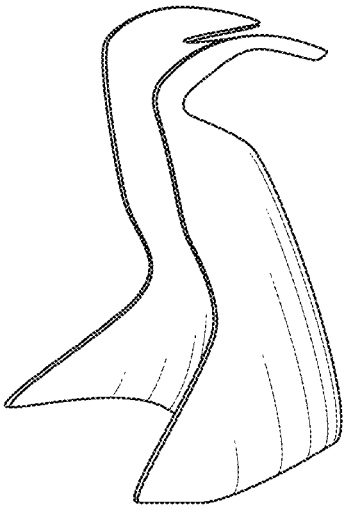
FIG. 4B is a perspective view of a compressed heel cup of FIG. 1.
Figure 4C:
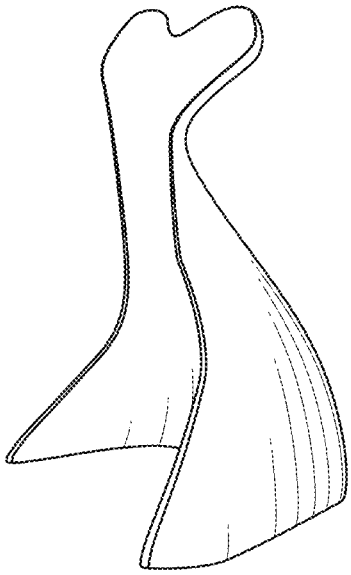
FIG. 4C is a perspective view of an uncompressed heel cup FIG. 1.
Figure 4D:
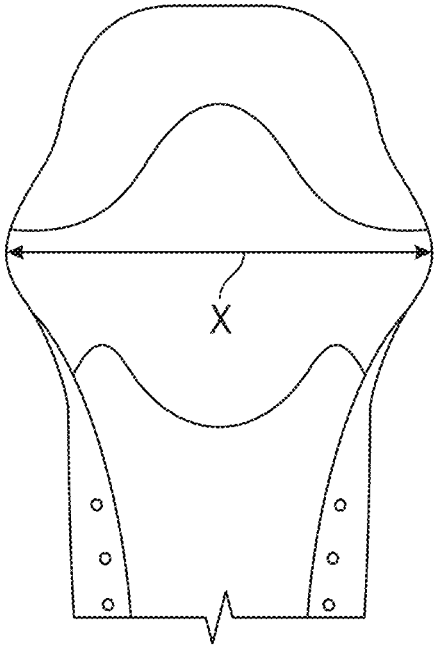
FIG. 4D is top view of a compressed shoe having the heel cup of FIG. 1.
Figure 4E:
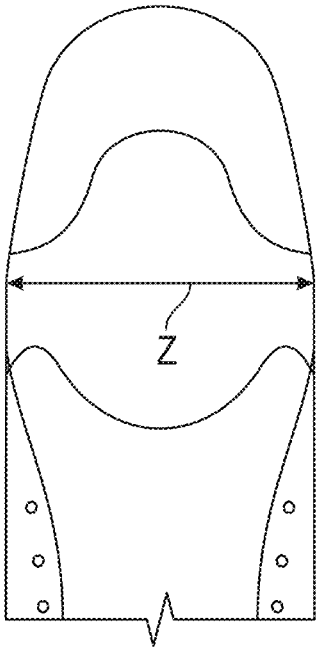
FIG. 4E is a top view of an uncompressed shoe having the heel cup of FIG. 1.
Figure 5:
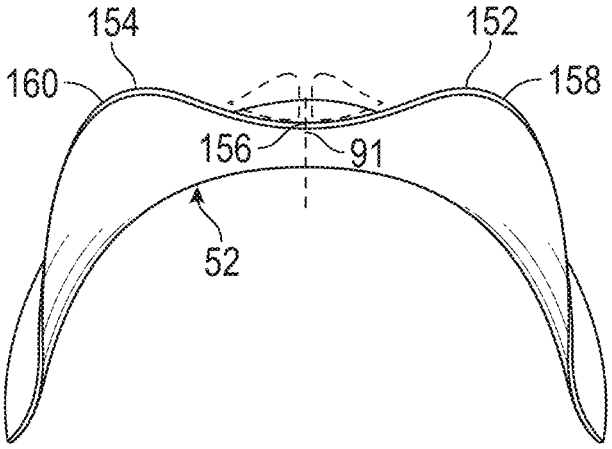
FIG. 5 is a top view of the compressible heel cup of FIG. 1.

Further to this embodiment, when a user dons the shoe 12, the top portion of the heel cup 52 or the uppermost segment of the heel counter 32 of the shoe 12 may be lowered and extend backward away from the foot as the heel counter 32 is compressed or folded as shown in FIG. 4B. This action may allow the user's foot to be inserted into the shoe opening 48 with a reduced degree of plantar flexion. During compression of the heel cup 52, portions of the heel cup 52 may move forward toward the direction of the forefoot portion. The distortion of the heel cup 52 may also include the attached heel counter 32 widening with the medial and lateral sides of the heel cup moving outward thereby widening the opening of the shoe. As shown in FIGS. 4D and 4E, he mediolateral widening of the shoe opening 48 from a width Z to width X allows easier entry such as easier insertion of the forefoot portion of the user's foot. In one exemplary embodiment, the shoe opening of 7.5 cm may widen up to 4 cm more or about 50%. The widening may be less or more depending on the size of the shoe and the flexibility of the heel cup. In some shoes, the desired widening may be less or greater depending on the needs of securement and use.

Figure 12:
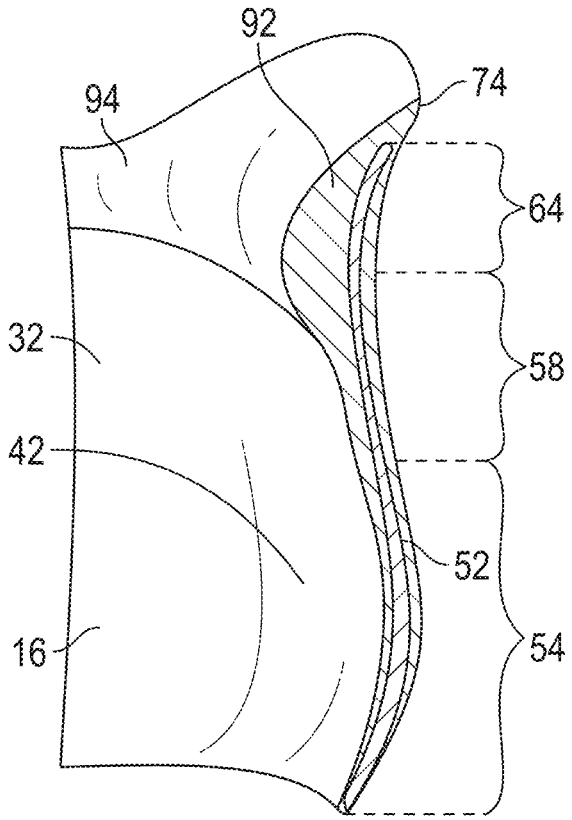
FIG. 12 is cross section of the heel counter with based on cross-section of the heel cup of FIG. 7.
Figure 13:
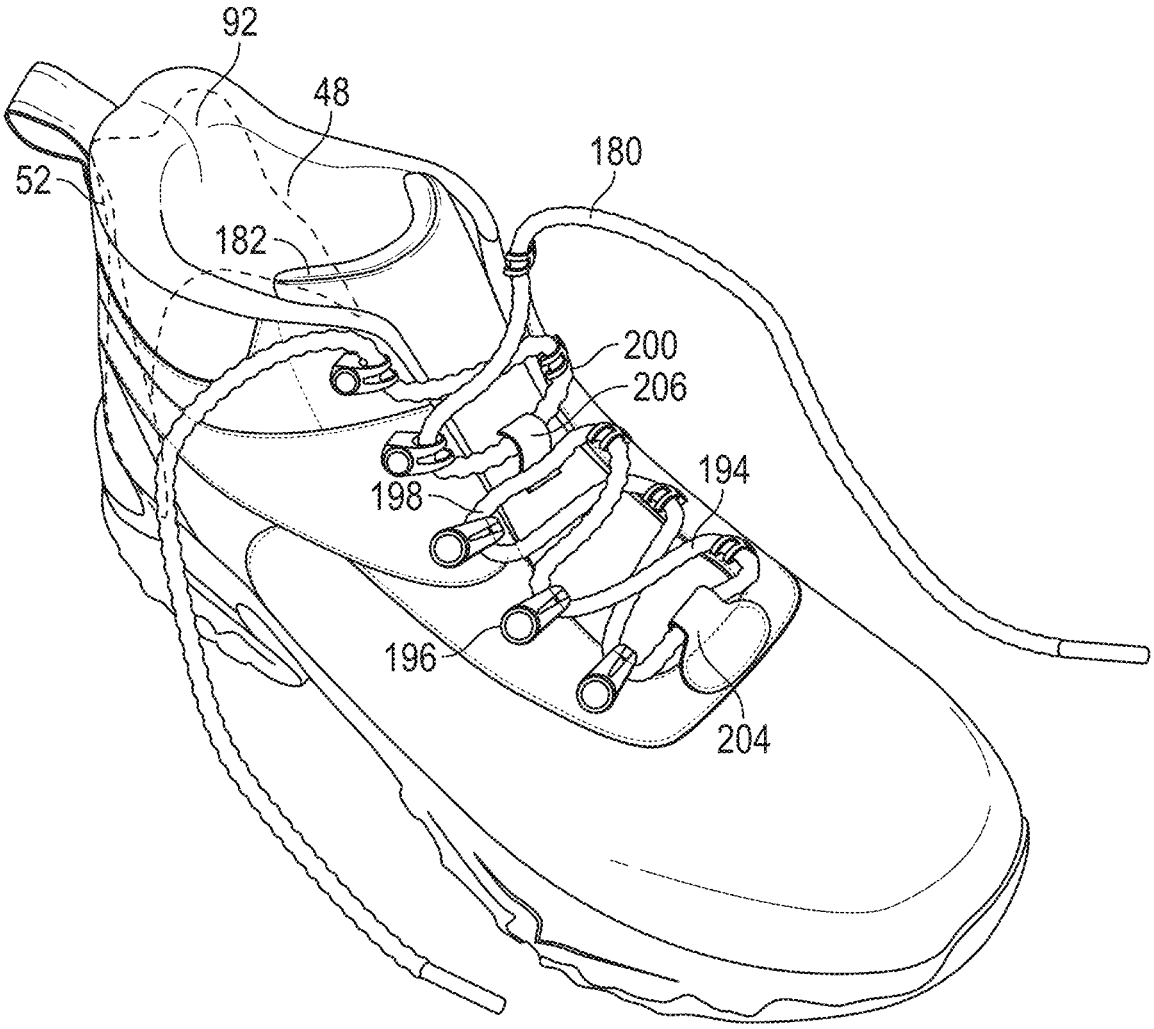
FIG. 13 is a perspective view of a shoe incorporating the heel cup of FIG. 1 and having an exemplary fastening system.
Figure 14:
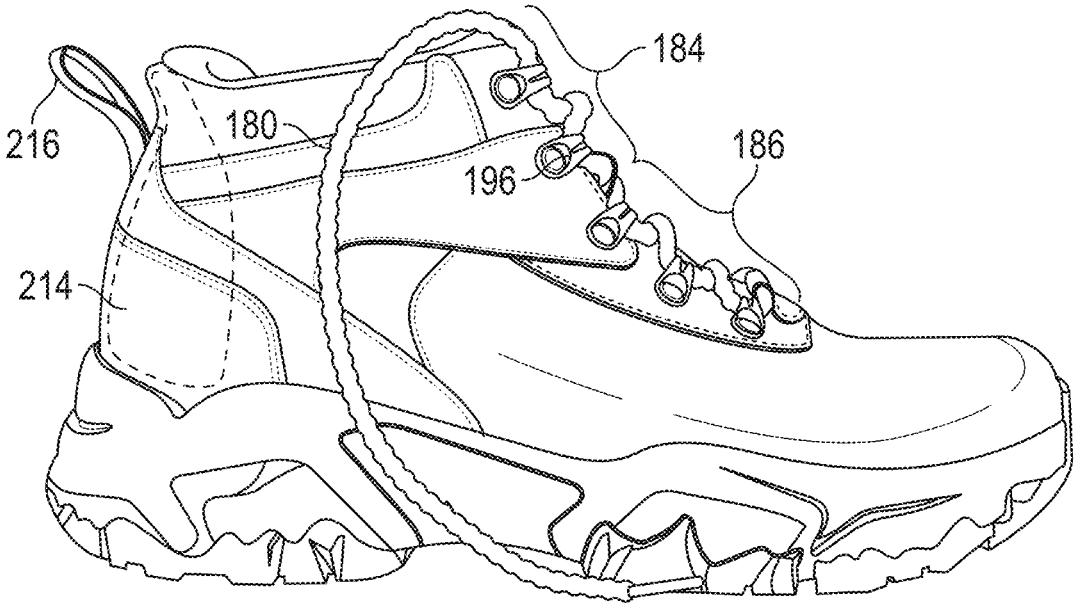
FIG. 14 is a profile view of the shoe of FIG. 13.
Figure 15:
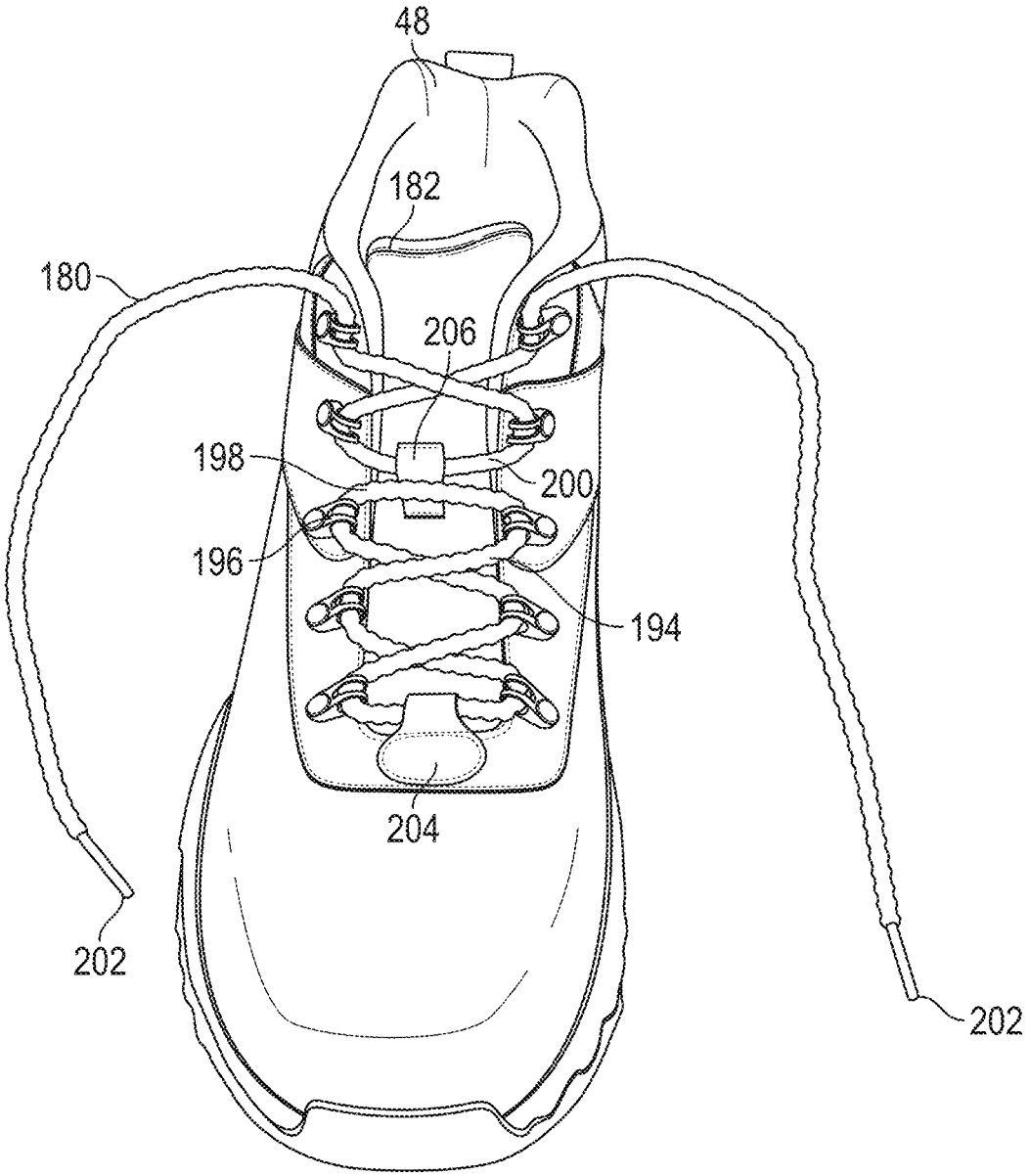
FIG. 15 is a perspective view of the shoe of FIG. 13.
Figure 16:
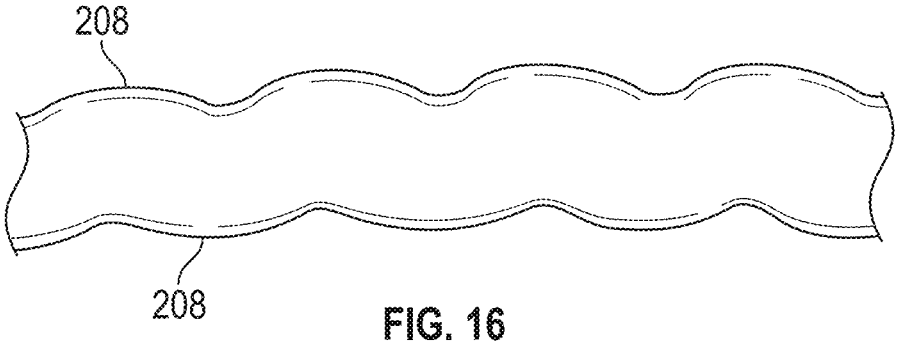
FIG. 16 is a side view of a portion of a lace.
Figure 17:
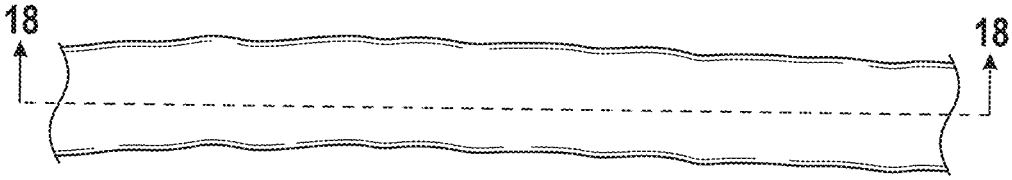
FIG. 17 is a side view of a portion of the lace of FIG. 16 rotated 90 degrees along its longitudinal axis.
Figure 18:
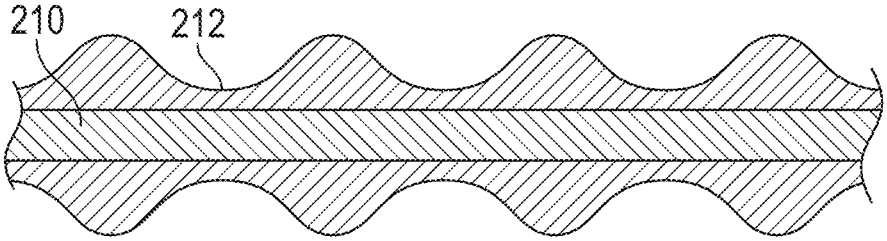
FIG. 18 is schematic illustration of a cross-section of the lace of FIG. 17 taken at lines 18-18.

In an exemplary embodiment of the heel cup 52 as shown in FIGS. 1-12, the thickness T1 of a heel cup 52 made of a polymer material, such as Dupont Hytrel, may range from 0.4 millimeters to 4 millimeters. The range of thickness T1 of the heel cup may be thinner or thicker at various regions depending on the desired elastic and durable properties of the material. For example, the midpoint region may be thinner than the surrounding regions, and in particular a central portion 50 may be thinner as shown in FIG. 7. The central portion 50 may be spaced away from the medial and lateral edges wherein the peripheral edges may have a greater thickness. Other suitable materials may include other thermoplastic elastomers or other polymers capable of providing the folding, bending, or compressible characteristics of the heel cup as described above. Further to the exemplary embodiment, the heel cup 52 may be attached at least to an interior compressible layer such as a foam layer 92, as shown in FIGS. 12 and 13. The heel cup 52 may be located in the interior of the heel counter 32 of the upper 16 as shown in FIGS. 12-14. The foam layer 92 may line both the inner wall of the heel cup 52 and outer wall of the heel cup 52. Around the upper portion and mid-portion, the foam layer 92 may protrude and extend further into the shoe opening 48 along the medial and lateral sides of the interior wall of the upper. The foam layer 92 may protrude be thicker along the interior collar portion 94 of the upper 16. The foam layer 92 may be thicker at or near the upper portion 64 and mid-portion 58 of the heel cup 52 thereby further forming part of the interior collar portion 94 of the shoe opening 48. The thicker foam layer 92 may provide securement of the user's foot once inserted within the shoe 12 as the foam would be located above the calcaneus bone region of the user's foot and extend around at least portions of the upper ankle region of the foot. The thicker portions of the foam layer may be compressed by the heel during foot insertion or removal. The thicker foam layer may be uncompressed fully or partially once the foot is inserted into the shoe such that the thicker foam layer aids in securing the foot by holding the ankle of the user's foot once the foot is inserted. A thinner foam material may be used to line the other portions of the heel cup 52 such as the lower portions of the heel cup and interior wall of the upper.

As shown in FIG. 12, a fabric material(s) or a suitable material(s) known in the art may be used to cover the heel cup 52 and foam layer 92 thereby forming the exterior layer 42 and interior layers or structures of the upper. The fabric material and foam layer may extend above the heel cup 52 thereby forming an extension of the heel collar 74.

A rigid heel cup 52 under the load of a foot exerted during the donning of the shoe may be used in combination with a shoe upper 16 having at least one elastic region 78 located on the sides of the upper between the heel cup 52 and the front portion of the foot receiving shoe opening 48. The elastic region 78 may have one or more elastic materials that allow the rear portion of the heel counter 32 to be temporarily moved back to widen the foot receiving shoe opening 48 for easier insertion of the foot into the shoe 12. The elastic material may be a gore material configured to be fixed within a void of the upper such as in the form of a gusset on the medial quarter or lateral quarter or both. The elastic material may be in any spacing between the heel cup 52 and the upper portion located at the quarters 30 or vamp 24 or possibly a tongue. The elastic material may also be configured as a series of elastic strips or webbing extending between the heel cup to the medial and lateral sides of the vamp or possibly a tongue.

Instep Support. In some embodiments, an instep support may be used to aid in preventing, in some instances, the instep of the user's foot from dragging a portion of the instep, or tongue partially into the throat area as the user dons the shoe.

In some embodiments having a tongue wherein the sides of the tongue are connected to the upper through a connecting layer. The front lower portion of the tongue is attached directly to the upper. Each of the medial and lateral sides may be attached to the upper directly to the inner lining of the upper through the connecting layer that is attached on or near the eyerow. The connecting layer may be folded such that the bend face away from the tongue and its ends are attached to the inner lining of the upper and the tongue side edges.

In other embodiments, each of the medial and lateral sides of the edge of the tongue or an upper portion of the tongue are attached by a gusset which may or may not be of elastic material, to the inner lining of the upper of the medial quarter and lateral quarter of the upper. The gusset similarly may function to maintain the general positioning of the tongue when the user dons the shoe. In another embodiment of the tongue, the at least a portion of the medial and lateral edges of the tongue may be directly affixed or stitched to the interior portion of the upper and the tongue. Furthermore, the tongue may be extended wider than a conventional tongue along the mediolateral direction in the upper portion of the tongue and the edges or some portion of the extended portion may be affixed or stitched to the interior portion of the upper.

In other embodiments, an instep or tongue support which may be constructed of a sheet-like material of greater hardness than the fabric of the instep or tongue may be attached to the outer surface of the tongue or embedded between an exterior tongue layer and an inner tongue layer facing the shoe opening. The instep or tongue support may reduce or prevent the instep or tongue from collapsing during the insertion of the foot.

Tensioning System. The heel cup may be used in combination with a tensioning system which has at least an adjustable lace and a fixed lace. The fixed lace provides sufficient elasticity to allow ease in entry and removal while also providing sufficient tension to secure the foot without the wearer having to use the wearer's hands to manipulate the fixed lace. The adjustable lace may be adjusted to the wearer's preferences of elasticity and tension which may be based on the desired securement, activity, or handsfree operation.

"Laces" may be any equivalent type of tension device including but not limited to a any shape or configuration of a shoelace (e.g., flat, round, wavy, or oval: wide or narrow: braided, etc.), a boot lace, elastic lace, bungee cord, wire, strap, string, band(s), or any other tensioning and fastening device known in the art. "Fixed lace" may be defined as lace that is fastened securely in a particular tension or elastic state. A fixed lace may have ends that are permanently affixed to each other. A fixed lace may still be adjustable so long as the end are permanently affixed.

Adjustable means may be buckles, rotary buckles, cord locks, or any means know in the art. "Adjustable lace" may be defined as a tensioning device that is able to be changed to suit a particular need. The adjustable lace may have any known adjustable method known in securing laces. The adjustable lace may be secured by tying at least a knot, or secured by a buckle, a rotary buckle, hook and loop attachments, cord locks, magnetic locks, a turnbuckle, or any known means or method in the art. An adjustable lace may also be a non-slip tie lace, non-slip knot lace, or locking lace to improve the fastening.

The fixed lace and adjustable lace may be located along the instep of the shoe over the tongue or along any other areas securing the opening of the shoe configured to receive the foot. The fixed lace may be located adjacent to the adjustable lace along an opening or loose region of the upper that is to be closed and/or secured with added tension around the foot. The fixed lace may be located proximal to the opening or further away. The adjustable lace may be located proximal to the opening or further away depending on the location of the fixed lace.

As shown in the exemplary embodiment of FIGS. 13-18, a shoe upper 16 may utilize an adjustable lace 180 tensioning system designed to optimize support, comfort, and functionality of handsfree donning by incorporating one or more distinct tensioning components along an opening of the shoe that is to be fastened. The opening may have a tongue 182 or vamp area. Further to this embodiment, there are two tensioning components: a first tensioning component 184 and a second tensioning component 186. The tensioning system enhances the fit by allowing independent adjustment of tension in different regions of the shoe, such as specifically targeting an upper region of the tongue 182 or vamp and a lower region of the tongue 182 or vamp.

The second tensioning component 186 is located in the lower region of the tongue 182 or vamp, nearer to the forefoot portion. The second tensioning component 186 is designed to secure at least a portion of the forefoot or lower instep, by distributing pressure evenly or as desired across the lower region of the tongue 182 or vamp.

The first tensioning component 184 is located in the upper region of the tongue 182 or vamp, near an ankle area. The first tensioning component 184 is designed to secure at least a portion of the ankle area or upper instep, by distributing pressure evenly or as desired across the upper region of the tongue 182.

In the exemplary embodiment, the second tensioning component 186 features a lower lace 194 which is a fixed, continuous lace 198 that is integrated into the shoe 12. The lower lace 194 is pre-threaded through eyelets 196 and may ends joined directly to each other or through a fastening means that may be adjustable, but stably locks the lower lace in particular state of tension and/or elasticity. The tension in this zone may be set during the manufacturing process and provide a more consistent tensioning support to the forefoot. The fastening means may be adjustable for a desired tension, but the ideal fastening would be one that is not easily released such that the second tensioning component is locked in particular state of tension and/or elasticity. However, it is also contemplated that the lower lace 194 of the same or differing tension may be replaced or substituted with another lace that may be in turn fixed. The eyelets holding the second tensioning component may be any type of eyelets or lace loops which may include, but not limited to D-rings, boot loops, grommets, or speed hooks.

Further to the exemplary embodiment, the first tensioning system 184, in contrast to the continuous lace 198, may employ an upper lace 200 with two free ends 202. The upper lace 200 with two free ends 202 can be adjusted and tied by the user to achieve the desired level of support around the ankle area. In the exemplary embodiment, the lower lace 194 is fastened in a crisscross pattern over the lower region of the tongue or vamp. The upper lace 200 with two free ends 202 is threaded in a crisscross pattern, allowing for independent adjustment of tension in the upper fastening region. The first tensioning system may also have an adjustable means such as any variety of buckle.

With the use of a hands-free entry shoe, and in the exemplary embodiment with a compressible heel cup 52, the adjustability of the upper fastening region 184 allows the user to customize the right amount of tension and the size of the shoe opening 48, optimizing the shoe for hands-free donning.

The second tensioning component 186 may include a central lace fastener 204, positioned in the forefoot portion at the center of the shoe either on a tongue or instep portion on the upper. This central lace fastener 204 forms a tunnel-like structure through which the lower lace is threaded, providing an additional anchoring point for the lower lace. The lower lace 194 may be attached or freely slide through the central lace fastener 204.

The first tensioning component 184 may be fixed an upper tongue loop 206 positioned at the center of the tongue 182. The upper tongue loop 206, through which the upper lace is threaded, helps to maintain the alignment of the tongue 182 and facilitates even distribution of tension across the upper portion of the foot. The upper lace 200 may be attached or freely slide through the upper tongue loop 206.

It is contemplated that any appropriate fastening mechanism known in the art may substitute for those describe in the exemplary embodiment for at least one of the first tensioning component and the second tensioning component. For example, a manual or motorized dial tightening system may be employed to customize tension. Various clasp and locking mechanisms known in the art may also be used to facilitate adjustment. Alternatively, a hook-and-loop fastener may be used individually or to secure the lace ends.

The shoelace lacing system described accommodates a variety of lace fasteners to guide the laces. Laces may be threaded through a diverse range of mechanisms known in the art, including traditional metal, plastic, or fabric eyelets, loop eyelets, corded eyelets, webbing eyelets, boot loops. D-rings, speed hooks, and plastic or metal tubes attached to the shoe upper material, and which guide the laces through designated pathways.

Any appropriate type and material of lace known in the art may be used. In the exemplary embodiment, the upper lace 200 and lower lace 194 are made of a stretch locking lace material and have a special function to prevent untying. The lace may also be a non-slip-tie or non-slip knot lace. The stretch locking lace may include a core strand 210 made from a material with uniform stretchability, facilitating even tension and flexibility across the respective region. The core strand 210 may be formed from multiple threads (e.g., braided, or parallel). Surrounding the core material is an outer strand 212. The outer strand 212 may be formed from multiple threads (e.g., braided, or parallel), and may exhibit stretchability to a lesser degree, greater degree, or same degree as the core strand 210. The outer strand 212 may have bulbs or nodes 208. These bulbs or nodes 208 may be evenly spaced in an undulating pattern, providing additional grip, for example by preventing the lace from easily slipping through a fastener.

In one exemplary embodiment, the lace may have an inner core of a plurality of inner strands. The strands may be rubber gore. The inner strands may be surrounded by an outer layer of material such as a woven, knit or mesh. The outer layer may be constructed to form a plurality of bulbs or nodes. The outer diameter of the lace may be 3 to 5 mm. The inner strands may each have a diameter between 0.3 to 0.6 mm. The lace is not limited to these exemplary materials or dimensions, but employ any materials and dimensions in the art.

The tongue of the shoe may be connected to the upper only in the forefoot region. Additionally, the tongue can be attached to at least the medial side and lateral side of the shoe upper in the lower fastening region and at least a portion of the upper fastening region. This attachment can be achieved through any appropriate means known in the art, such as stitching or by using an additional material attachment layer, which may include elastic materials. An additional material attachment layer, which may include elastic materials, may facilitate maintaining the position of the tongue so that it does not collapse into the shoe opening during donning and also facilitates expanding the shoe opening during donning.

Although the present invention has been described above by referring to particular embodiments, it should be understood that modifications and variations could be made to the sole structure without departing from the intended scope of invention.

We claim:

1. A shoe comprising:

a heel counter having a uniformly molded internal heel cup, wherein the heel cup comprises an upper portion with a top edge having medial elevated point and a lateral elevated point separated by a recessed point along a median line of the heel cup;

a tapering thickness in a medial crest region and lateral crest region being different from a thickness in a trough region, the trough region providing differential flexibility from at least one of the medial crest region and lateral crest region;

the upper portion of the heel cup having an overall downward incline with a first angle relative to a vertical line that is normal to a level plane of the floor, the heel cup having an uppermost portion extending rearward; and wherein the heel cup is disposed between layers of the upper and attached to a foam layer; the foam layer following a top line edge of the heel cup so as not to completely occupy the region between the medial crest region and the lateral crest region, thereby leaving at least a portion of the trough region unfilled by the foam layer.

2. The shoe of claim 1, wherein the heel cup is a compressible heel cup having an upper portion, the upper portion has a first configuration, and a second configuration wherein the second configuration is distorted under a load of a user's foot, when the user is donning the shoe, wherein in the second configuration, at least part of the upper portion is lowered relative to the first configuration and the upper portion is configured to return to the first configuration after the load of the user's foot is removed.

3. The shoe of claim 2, wherein the second configuration comprises the heel counter widening with a medial side and a lateral side of the heel counter moving outward away from a shoe opening.

4. The shoe of claim 1, wherein a vertical cross section of the heel cup is on a plane intersecting at least one of the medial elevated point and a lateral elevated point and the vertical cross section has a first S wave shape.

5. The shoe of claim 4 wherein the first S wave shape has a lower concavity and an upper concavity, and the lower concavity is deeper than the upper concavity.

6. The shoe of claim 5 wherein the second S wave shape has an upper concavity that is deeper than a lower concavity.

7. The shoe of claim 1, wherein a vertical cross section of the heel cup along the median line has a second S wave shape.

8. The shoe of claim 1, wherein the thickness of the trough region is greater than thickness in the medial crest region and lateral crest region.

9. The shoe of claim 1, wherein the tapering thickness extends from the medial crest region and lateral crest region toward the topline edge and gradually reduces in thickness.

10. The shoe of claim 1, wherein the shoe further comprises a tensioning system, wherein the tensioning system has a first tensioning system and a second tensioning system, and the first tensioning system is adjustable, and the second tensioning system is fixed.

11. The shoe of claim 10, wherein the second tensioning system is located further from a shoe opening than the first tensioning system, and the first tensioning system is adjusted to a tension sufficient to allow a foot entry into the shoe without use of hands.

12. The shoe of claim 1, wherein the medial crest region and the lateral crest region have different flexibilities.

13. The shoe of claim 1, wherein the medial elevated point and the lateral elevated point have differing heights.

14. The shoe of claim 1, wherein the thickness of the central portion provides for greater flexibility than the trough region.

15. The shoe of claim 1, wherein along the median line the trough region has a first thickness and a central portion of the heel cup has a second thickness; and the first thickness is greater than the second thickness.

* * * * *